United States Patent [19]

Hauser et al.

[11] Patent Number: 4,896,617

[45] Date of Patent: Jan. 30, 1990

[54] BLIND STITCH SEWING MACHINE

[75] Inventors: Georg Hauser, Münich; Rolf Höggenstaller, Wessling, both of Fed. Rep. of Germany

[73] Assignee: J. Strobel & Sohne GmbH & Co., Munich, Fed. Rep. of Germany

[21] Appl. No.: 359,327

[22] Filed: May 31, 1989

[30] Foreign Application Priority Data

Jun. 3, 1988 [DE] Fed. Rep. of Germany ..... 3819017

[51] Int. Cl.[4] ..... D05B 1/24

[52] U.S. Cl. ..... 112/176; 112/121.11

[58] Field of Search ..... 112/176, 177, 178, 121.11, 112/267.1, 268.1, 35

[56] References Cited

U.S. PATENT DOCUMENTS

| | | | |
|---|---|---|---|
| 4,043,284 | 8/1977 | Rau et al. | 112/178 |
| 4,184,442 | 1/1980 | Maier | 112/178 |
| 4,633,794 | 1/1987 | Kato | 112/121.11 |
| 4,718,365 | 1/1988 | Hauser et al. | 112/176 |

FOREIGN PATENT DOCUMENTS

| | | |
|---|---|---|
| 930058 | 7/1955 | Fed. Rep. of Germany . |
| 2511568 | 2/1978 | Fed. Rep. of Germany . |
| 3015433 | 11/1981 | Fed. Rep. of Germany . |
| 3323214 | 10/1984 | Fed. Rep. of Germany . |
| 3519849 | 10/1986 | Fed. Rep. of Germany . |
| 3519729 | 12/1986 | Fed. Rep. of Germany . |
| 988628 | 7/1965 | United Kingdom . |

*Primary Examiner*—Peter Nerbun

*Attorney, Agent, or Firm*—Bacon & Thomas

[57] ABSTRACT

The invention concerns a blind stitch sewing machine with an oscillating fabric deflector to make the sewing material bulge into the arcuate path of the arc needle. The minimum spacing of the deflector relative to the arc needle can be adjusted in relation to the thickness of the sewing material detected by a sewing material sensor. A stepping motor is provided to adjust this minimum spacing. A stepping motor control circuit is connected to the sewing material sensor, and to a contact pickup for the arc needle and fabric deflector, the stepping motor being controlled in such a manner that, upon a control circuit start signal, it moves into a particular start position and proceeds during the ensuing sewing by one step per stitch reducing the minimum spacing of the fabric deflector until the contact pickup emits a contact signal relative to the arc needle and the fabric deflector during a measurement window signal. At the end of this signal, the stepping motor moves in the opposite direction by a number of steps dependent on the output signal of the sewing material sensor, to increase the minimum spacing of the fabric deflector.

24 Claims, 6 Drawing Sheets

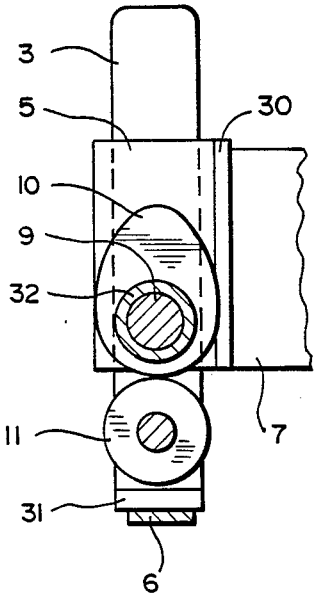
FIG. 2
FIG. 3
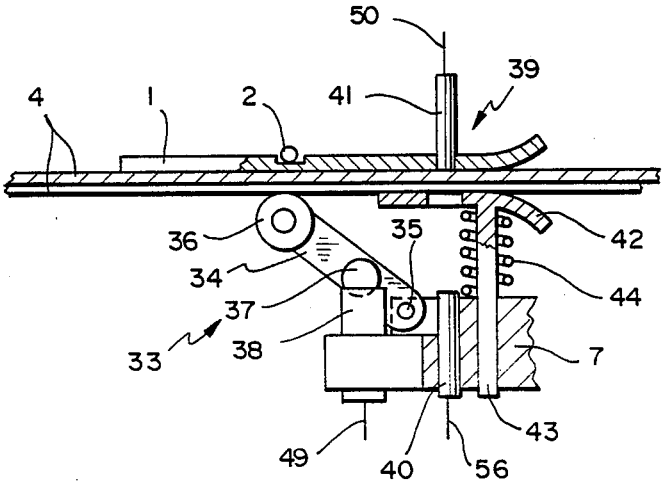

BLIND STITCH SEWING MACHINE

BACKGROUND OF THE INVENTION

The invention concerns a blind-stitch sewing machine with an oscillating fabric deflector to bulge the sewing material fabric into the arcuate path of an arc needle. The minimum spacing between the fabric deflector and the path of the arc needle is adjustable by a control circuit including a sewing material sensor in relation to the thickness of the sewing material.

Blind-stitch sewing machines are known in the art as evidenced by German Pat. No. 25 11 568. In a typical design, the sewing material sensor is mounted near the stitch zone and is connected by link means to the fabric deflector, to adjust the minimum spacing of the fabric deflector relative to the thickness of the sewing material between a throat plate and the sewing material sensor, that is the distance up to which the fabric deflector driven by an oscillating shaft and oscillating synchronously with the arc needle may approach the needle's path.

In blind-stitch sewing machines for point wise sewing of material by means of a predetermined number of stitches while the fabric deflector is motionless, it is known to set the spacing of the fabric deflector from the arcuate path of the arc needle by means of a cam acting as a stop, wherein the cam may be rotated by an electric stepping motor. The stepping motor may be connected to an electric control circuit having a memory for several different spacings between the fabric deflector and the path of the arc needle when sewing takes place. These spacings can be requested individually by a selector connected to the control circuit and actuated manually, whereby the stepping motor correspondingly drives the cam (German Pat. No. 35 19 849).

Moreover, it is within the state of the art as regards to such blind-stitch sewing machines having oscillating fabric deflectors with manual setting of its least spacing from the path of the arc needle to provide an alarm emitting an acoustical and/or an optical warning signal in the event that too small a minimum fabric deflector spacing has been set. This alarm includes an electric switch which, in that case, is closed (British Pat. No. 9 98 628).

Similarly, spring loaded depressing means are known in such blind-stitch sewing machines which press the sewing material, during the sewing procedure, against the oscillating fabric deflector to prevent it from being shifted transversely to the direction of sewing upon entry of the arc needle (German Offenlegungsschrift 30 15 433).

Light barriers of various designs are known for use in sewing machines, including such barriers recognizing sewing material edges transverse to the direction of sewing (German Pat. No. 33 23 214 and German Offenlegungsschrift 35 19 729).

Lastly, it is known relative to blind-stitch sewing machines to make the oscillating drive shaft of the fabric deflector hollow and to rotatably rest it on an inner support shaft. The inner support shaft, in tunr, rests eccentrically in a housing or frame of the sewing machine so as to be driven in an oscillatory manner to assure interval operation of a sewing machine and to periodically change the spacing between the fabric deflector and the arcuate path of the arc needle (German Pat. No. 9 30 058).

SUMMARY OF THE INVENTION

It is the object of the invention to create a blind-stitch sewing machine of the species cited above wherein the particular minimum spacing between the fabric deflector and the arc needle path required for satisfactory blind stitches can be adjusted even more precisely, that is, while taking into account all of the pertinent properties of the sewing material and the needle and practically without the material sensor affecting this material.

The invention concerns a blind-stitch sewing machine with an oscillating fabric deflector to make the sewing material bulge into the arcuate path of the arc needle wherein the minimum spacing between the fabric deflector and the arc needle can be adjusted in relation to the thickness of the sewing material detected by a sewing material sensor. A stepping motor is provided to adjust the minimum spacing of the fabric deflector. A control circuit is connected to the stepping motor, the sewing material sensor and a contact pickup for the arc needle and fabric deflector. The stepping motor is controlled in such a manner that, upon a control circuit start signal, it moves into a particular start position and proceeds, during the ensuing sewing operation, by one step per stitch to reduce the minimum spacing of the fabric deflector until the pickup emits a contact signal indicating contact between the arc needle and the fabric deflector during a measurement window signal. At the end of this signal, the stepping motor moves in the opposite direction by a number of steps dependent on the output-signal of the sewing material sensor, to establish the minimum spacing of the fabric deflector.

BRIEF DESCRIPTION OF THE DRAWINGS

One embodiment of the blind-stitch sewing machine according to the invention is illustrated by the attached drawings in which:

FIG. 2 is a sectional view taken along line II—II of FIG. 1;

FIG. 3 is a sectional view taken along line III—III of FIG. 1;

DETAILED DESCRIPTION OF THE PREFERRED EMBODIMENT

Figure 1:
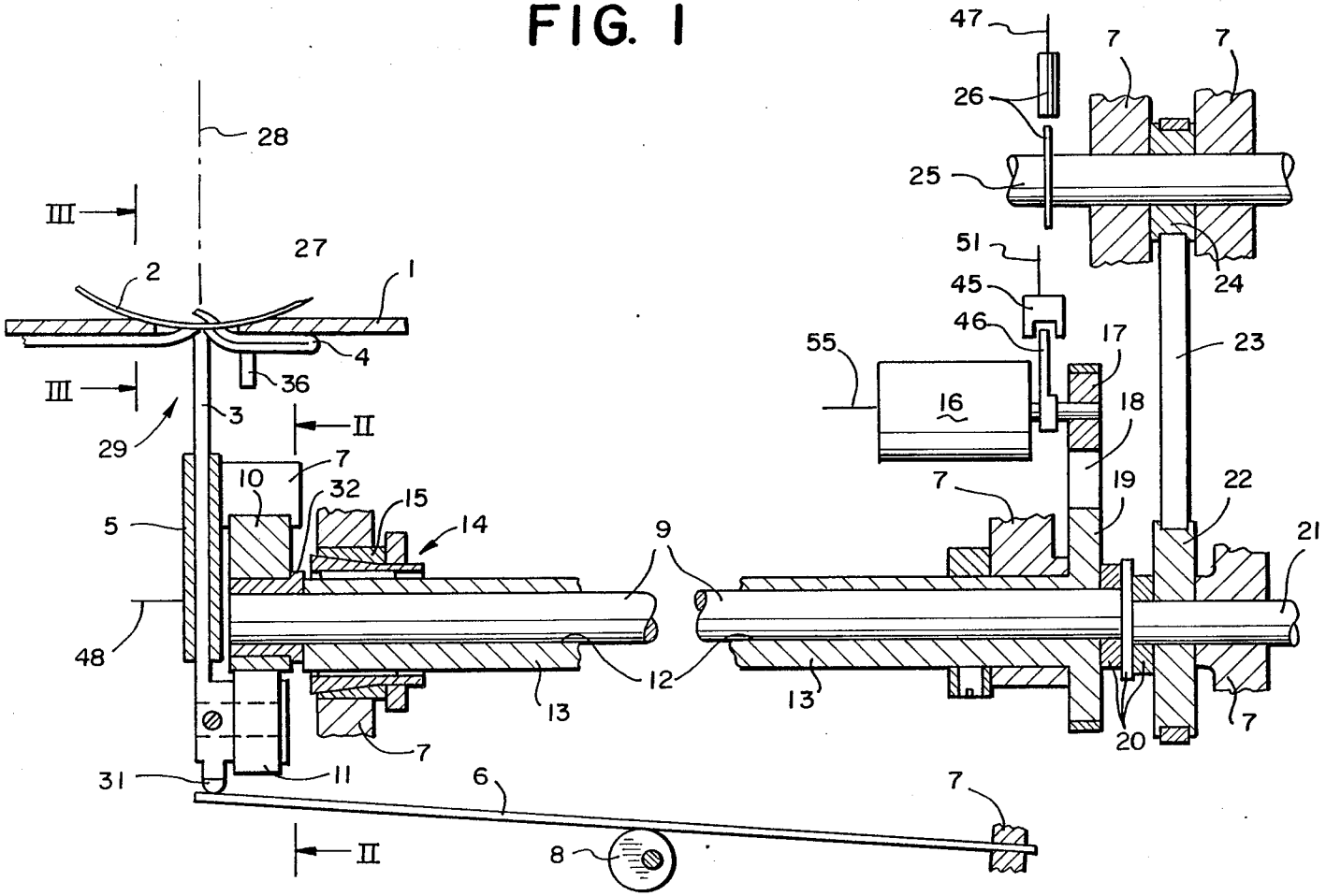
FIG. 1 is a schematic illustration of the components of a blind-stitch sewing machine according to the invention.

The blind-stitch sewing machine according to the invention comprises an arc needle 2 swinging to and fro along an arcuate path above a throat plate 1 in the plane of the drawing of FIG. 1, and, below thi throat plate 1, a fabric deflector 3 moving, during sewing, up and down in a plane of movement 28 synchronously with the arc needle 2. The fabric deflector 3 makes the sewing material fabric 4 bulge into the path of the arc needle 2, whereby the sewing thread is not visible at the lower side of the sewing material 4.

The planar fabric deflector 3 is axially movable within a guide sleeve 5 and is biased toward the throat plate 1 by a leaf spring 6 clamped to the machine frame 7 at its end away from the fabric deflector 3. The spring 6 cooperates with a cam 8 rotatable in the machine frame 7 in order to adjust the spring loading of the fabric deflector 3. The fabric deflector 3 is actuated by a drive shaft 9 having a cam 10 mounted on an end adjacent to the fabric deflector 3. A wheel 11 is rotatably supported on the fabric deflector 3 and is pressed by the leaf spring 6 against the cam 10.

The drive shaft 9 of the fabric deflector 3 is rotatably supported in the eccentric bore 12 of an eccentric sleeve 13, the eccentric sleeve 13 in turn being rotatably supported in the machine frame 7 and by means of a needle bearing 14 at the end adjacent to the fabric deflector 3. The outer race of the needle bearing 14 has a conical outer surface and is clamped by a clamping ring 15 having a corresponding conical bore in the machine frame 7 to achieve a bearing for the eccentric sleeve 13 as free of play as possible and hence rigidly stationary. Eccentric sleeve 13 can be rotated by an electric stepping motor 16, of which the output shaft is equipped with a cogwheel 17 engaging a toothed belt 18. A cogwheel 19, also engaging toothed belt 18, is provided on the eccentric sleeve 13. The drive shaft 9 is connected by an offset compensating coupling 20, preferably an Oldham type coupling, to a second drive shaft 21 rotatably supported in the machine frame 7. A cogwheel 22 mounted on second drive shaft 21 is connected by a tooth belt 23 to a cogwheel 24 on the main drive shaft 25 of the blind-stitch sewing machine.

A measurement window pickup 26 is operatively associated with the main shaft 25 rotatably supported in the machine frame 7 and emits one measurement window signal "A" for each revolution of the main shaft 25, beginning shortly before the tip 27 of the arc needle 2 arrives at the plane of motion 28 of the fabric deflector 3, and ending with the onset of the return motion of the fabric deflector 3 away from path of the arc needle 2, that is, in FIG. 1, downward. Moreover, a contact pickup sensor 29 to generate a signal upon contact between the arc needle and the fabric deflector is provided. The sensor 29 is formed by the fabric deflector 3 which is electrically insulated from the machine frame 7 and loaded with a low amplitude, high frequency alternating current to achieve capacitive coupling with the arc needle 2. The electrical insulation of the fabric deflector 3 is implemented by: an insulating plate 30 (FIG. 2) between the guide sleeve 5 and the machine frame 7; an insulating stub 31 between the fabric deflector 3 and the leaf spring 6; and an insulating sleeve 32 between the drive shaft 9 and the cam 10.

A sewing material sensor 33 shown in FIG. 3, underneath the throat plate 1 measures the thickness of the particular sewed material 4 and comprises a pivot arm 34 rotatably supported at one end about a pin 35 on the machine frame 7 having at the other end a sensing roller 36 bearing against the sewing material 4 and equipped between the ends with a permanent magnet 37. The pivot arm 34 is spring loaded toward the throat plate 1. The sewing matrial sensor 33 furthermore has a magnetic-field sensor 38 mounted on the machine frame 7 and cooperating with the permanent magnet 37. Also, in the zone of the throat plate 1 and, as seen in the direction of advance of the sewing material, a light barrier 39 is located in front of the arc needle 2. Light barrier 39 has a light source 40 and a light detector 41 mounted respectively to the machine frame 7 and the throat plate 1. In order to move the sewing material 4 at constant height, without folds and without elongation between the light source 40 and the light detector 41, a sheet metal guide 42 for the sewing material 4 is provided in the zone of the light barrier 39 underneath the throat plate 1. The guide 42 is displaceably guided by a foot 43 slidably mounted in the machine frame 7 and is biased by a spring 44 towards the throat plate 1.

The electric stepping motor 16 of FIG. 1 is equipped with a yoke light barrier 45 which cooperates with an arm 46 on the output shaft of the stepping motor 16 in order to emit a signal when the arm 46 interrupts the light beam by passing between the arms of the yoke light barrier 45.

Figure 4:
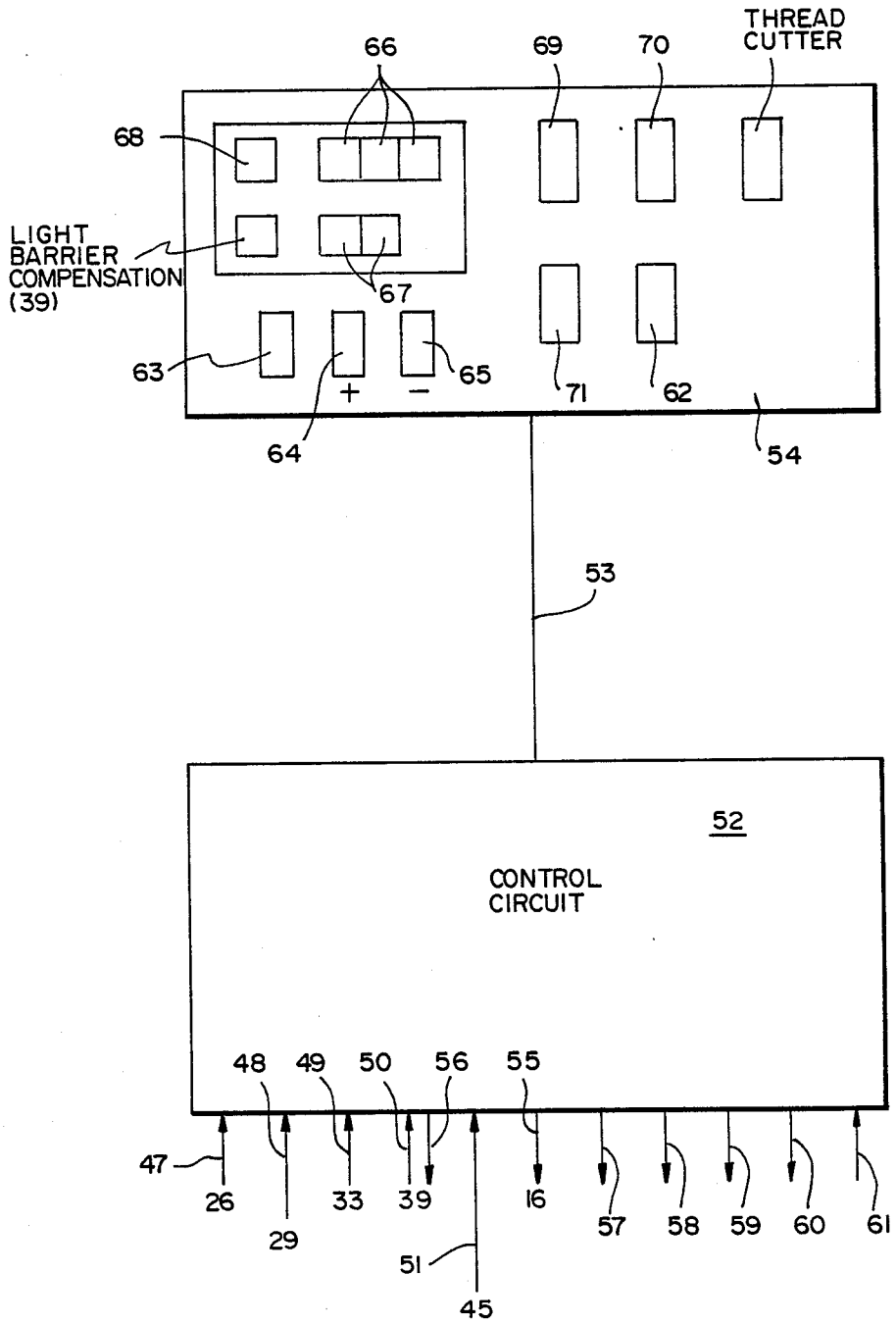
FIG. 4 is a schematic diagram of the electric control circuit, and of the operational and display panel of the blind-stitch sewing machine shown in FIGS. 1–3.

The measurement window signal pickup 26, also called herein pickup 26, the contact pickup 29 for the arc needle and the fabric deflector, the magnetic field sensor 38 of the sewing material sensor 33, the light detector 41 of the light barrier 39 and the yoke light barrier 45 are each connected by electric conductors, respectively 47, 48, 49, 50 and 51 to the electric control circuit 52. Control circuit 52, as shown in FIG. 4, consists of commerical components, for instance at least one microprocessor, memories, etc., as required for its various functions and is connected by electrical cable 53 to operating and display panel 54, i.e., to its various components. Electrical conductors 55 through 60 connect the control circuit 52 to the stepping motor 16; the light source 40 of the light barrier 39; an (not shown) for a depressor means (not shown) associated with the fabric deflector 3; drive motor (not shown) of the main shaft 25; a thread-severing drive (not shown); and an actuation means (not shown) for a thread tensioner (not shown). By means of electrical conductor 61, a signal may be applied to the control circuit 52 indicating that the fabric deflector 3 has been moved from the position in which the sewing material is to be introduced into the blind-stitch sewing machine to the position in which sewing may take place. Ordinarily, the displacement between these two positions is implemented by operator's pedal.

During sewing, the drive shaft 9 of the fabric deflector 3 is continuously driven from the main shaft 25 through the interconnection of toothed belt 23 with cogwheels 22 and 24; and the connector 20 between second shaft 21 and drive shaft 9. Rotation of drive shaft 9 displaces the fabric deflector 3 by means of the cam 10 and wheel 11 against the action of the leaf spring 6, whereby the fabric deflector 3 oscillates in the plane of movement 28 synchronously with the swings of the arc needle 2. In the process, the fabric deflector 3 can approach the path of the arc needle 2 only as much as allowed by the particular rotational adjustment of the eccentric sleeve 13 in the machine frame 7. This rotational setting can be changed by the stepping motor 16 through the toothed belt drive 17, 18, 19 to adjust the minimum distance of the fabric deflector. Stepping motor 16 is driven from the electronic control circuit 52 through the conductor 55.

Figure 6:
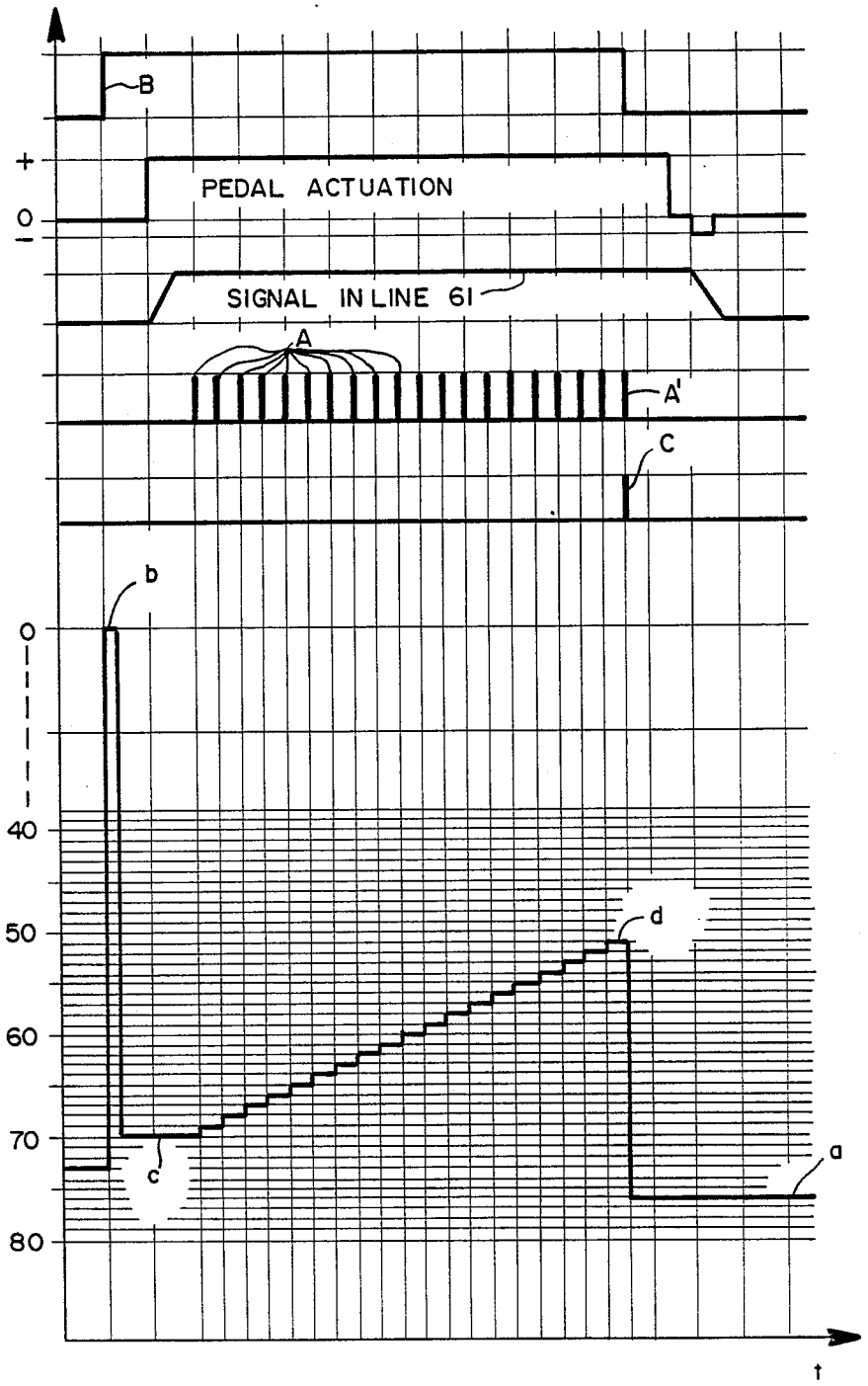
FIG. 6 is a chart illustrating how the start position of the stepping motor is reached in the blind-stitch sewing machine of FIGS. 1–3; and, FIG. 7 is a chart illustrating how to adjust the minimum spacing of the fabric deflector in the blind-stitch sewing machine of FIGS. 1–3.

When setting the minimum distance of the fabric deflector 3 in relation to the thickness of the particular sewing material 4, it is necessary to being with a given starting position "a" of the stepping motor 16, this position "a" depending on the particular arc needle 2. The starting position "a" is determined upon every change of needle 2, without the presence of thread of sewing material at minimal speed of the blind-stitch sewing machine. The operation commences by depressing key 62 of the operational and display panel 54 in order to energize the control circuit 52 through the cable 53 by means of the trigger signal "B" shown in FIG. 6. As a result, control circuit 52 moves the stepping motor 16 into reference position "b" of FIG. 6 wherein the minimum spacing of the fabric deflector 3 corresponds to a set, null position and where the yoke light barrier 45 emits its cited signal which, through the conductor 51 is supplied to the control circuit 52. Thereupon, the stepping motor 16 moves in an opposite direction by a certain number of steps into the initial position "c" of FIG. 6, whereby the minimum spacing of the fabric deflector 3 is correspondingly enlarged and the arc needle 2 cannot touch the fabric deflector 3. If now the blind-stitch sewing machine is made operative by actuating the operators pedal, the stepping motor 16 moves by one step for each mesurement window signal "A" received through the conductor 47 at the control circuit 52, with a corresponding decrease in the minimum spaciang of the fabric deflector 3, until the contact pickup 29 emits a contact signal "C" for the arc needle and fabric deflector during a measurement window signal "A", as shown by FIG. 6. Thereupon, a number of steps corresponding to such enlargement of the minimum spacing of the fabric deflector 3 is added to the extant rotational positon "d" of the stepping motor 16, as necessary for taking into account the tolerances relating to the sewing machine and to the arc needle, and data relating to the starting position "a" so obtained is then stored.

Figure 7:
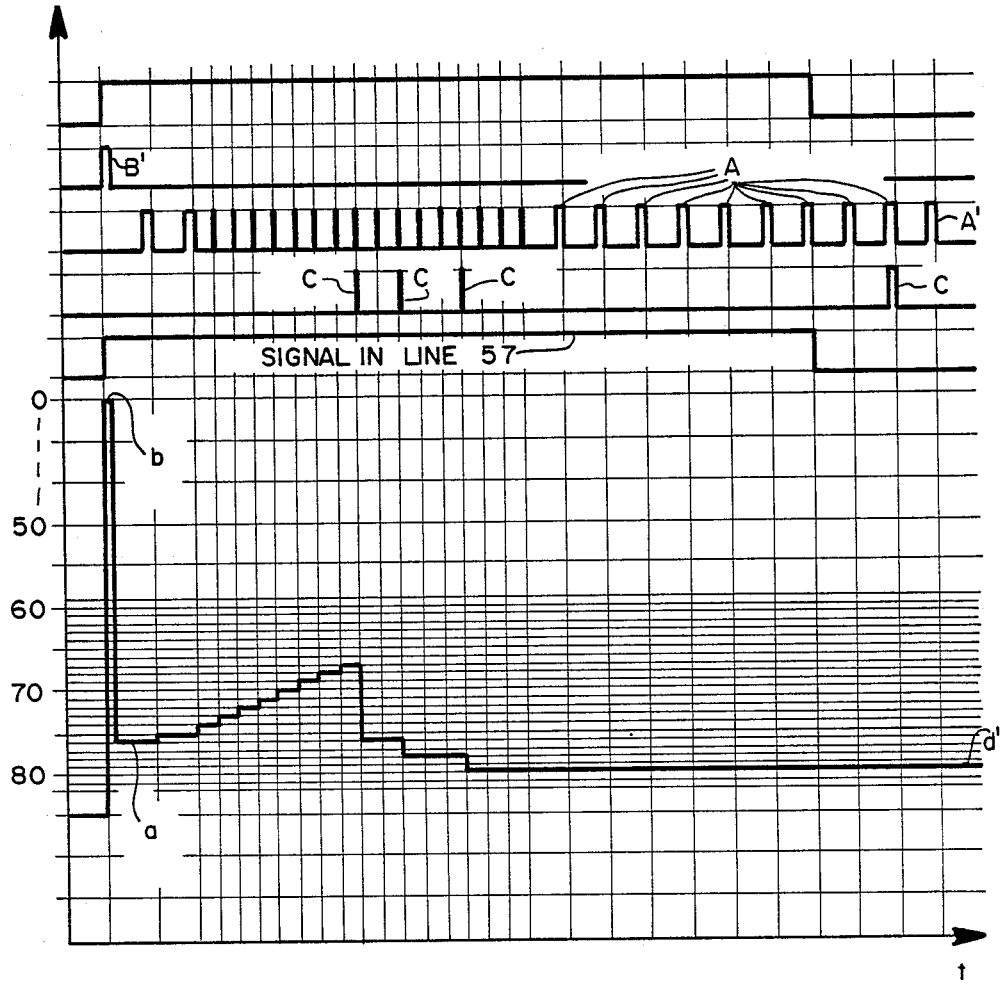

FIG. 7 illustrates the actual setting of the minimum spacing of the fabric deflector in relation to a particular sewing material 4. First, key 62 is depressed again to apply the start signal "B" through cable 53 to the control circuit 52 as shown in FIG. 7. Consequently, the stepping motor 16 moves first into the reference position "b" and then into the starting position "a" as determined above. Thereupon, as sewing takes place, stepping motor 16 moves by one step for each stitch with a corresponding decrease in the minimum spacing of the fabric deflector 3 until the contact pickup 29 emits a contact signal "C" relative to the arc needle 2 and the fabric deflector 3 during a measurement window signal "A". At the end of the measurement window signal "A", the stepping motor 16 moves by a number of steps, depending on the output signal from the sewing material sensor 33, in the opposite direction, whereby the minimum spacing of the fabric deflector is correspondingly enlarged. If, during further sewing, a contact signal "C" for the arc-needle 2 and fabric deflector 3 occurs during a measurement window signal "A", the stepping motor 16 will, each time, move further by a nubmer of lesser steps, but still dependent on the output signal from the sewing material sensor 33, whereby the minimum spacing of the fabric deflector is correspondingly and further enlarged. The control circuit 52 is designed such that the stepping motor 16 can no longer be actuated during further sewing in the absence of a contact signal "C" relative to the arc needle and fabric deflector for a given number of stitches during a measurement window signal "A".

As illustrated in FIG. 7, control circuit 52 emits a signal through the conductor 57 while the minimum spacing of the fabric deflector is being adjusted in order to further load the sewing material depressor means (not shown) so that the latter shall exert increased pressure on the sewing material 4 between the fabric deflector 3 and itself, to increase the sensitivity of the contact pickup 29 for the arc needle 2 and the fabric deflector 3.

Data relating to the minimum spacing of the fabric deflector so adjusted, i.e., the corresponding rotational setting "d" fo the stepping motor 16, remains stored in the control circuit 52, so that when subsequently sewing equal sewing materials 4, the procedures illustrated by FIG. 7 need not be repeated each time. Instead, this setting of the minimum spacing of the fabric deflector 3 by means of the control circuit 52 and the stepping motor 16 can be shut off by actuating the key 62. It is possible, furthermore, to adjust the minimum spacing of the fabric deflector arbitrarily by depressing key 63 of the oeprational and display panel 54 in order to correspondingly preset the control circuit 52 through the cable 53. Depressing thereupon key 64 or key 65 of the operational and display panel 54 enlarges or reduces respectively, the particular minimum spacing of the fabric deflector 3 by means of the stepping motor 16. The actual minimum spacing of the fabric deflector is digitally displayed by a three figure LCD display 66 showing the corresponding number of steps by which the stepping motor 16 has rotated out of the reference position "b". The two figure LCD display 67 of the operational and display panel 54 shown in FIG. 4 indicates the number of stitches determined by the contact pickup 29 of the arc needle and fabric deflector and counted in the control circuit 52.

Figure 5:
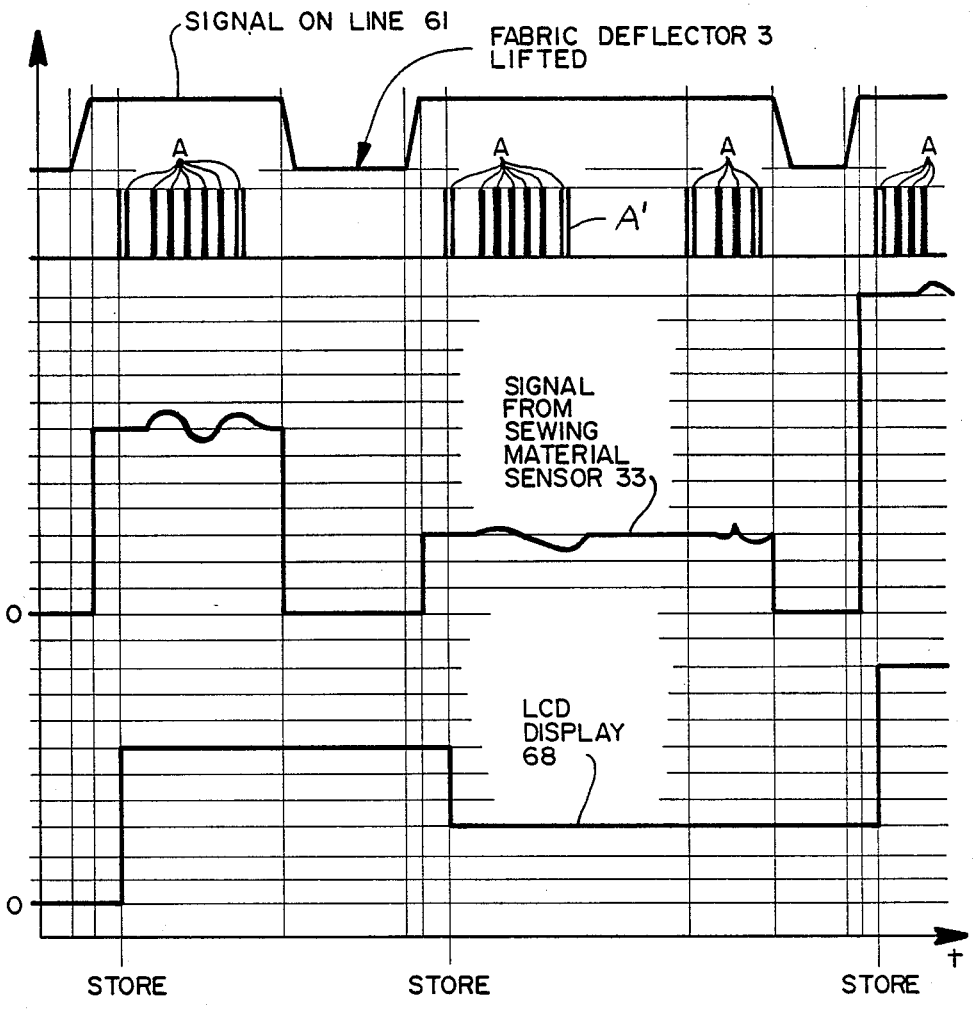
FIG. 5 is a chart illustratifng the measurement of the thickenss of the sewing material in the blind-stitch sewing machine of FIGS. 1–3.

FIG. 5 shows that the output signal of the magnetic field sensor 38 of the sewing material sensor 33 is detected only during the first measurement window signal "A" appearing during sewing and is stored in the control circuit 52 in order to compute from it the above cited data for setting the minimum spacing of the fabric deflector according to FIG. 7, and to indicate the ascertained thickness of the sewing material 4 by digits, for instance, from 0 to 9 in a single place LCD display 68.

By pressing key 69, of FIG. 4 the blind-stitch sewing machine can be switched to interval operation, namely, when being depressed once, to a 1:2 interval; and, when depressed twice, to 1:3 interval. Depressing the key 69 three times shuts off the interval operation. During such interval operation, the control circuit 52 driven through the cable 53 causes the stepping motor 16 to move by a number of steps depending ont he output signal of the sewing matrial sensor 33 with corresponding enlargement of the minimum spacing of the fabric deflector for each interval stitch. When raising the fabric deflector 3 by means of the operator's pedal, the control circuit 52 is switched back to normal operation.

Similarly, the blind-stitch sewing machine can be switched over to seam locking operation by depressing a key 70. The control circuit 52 then is actuated through the cable 53 and causes the stepping motor 16 to adjust by a number of steps for a given number of stitches, the number of steps depending on the output signal of the sewing material sensor 33, with corresponding enlargement of the minimum spacing of the fabric deflector 3.

Lastly, a key 71 may be depressed to operate the blind-stitch sewing machine with cross seam recognition, and for that purpose the control circuit 52 is actuated through the cable 53 and switched over to the appropriate state. If then the light barrier 39 emits a cross seam signal, first the angular speed of the main shaft 25 is reduced and then the stepping motor 16 adjusts itself by a number of steps dependent on the output signal of the sewing material sensor 33 with corresponding enlargement of the minimum spacing of the fabric deflector. At the end of the cross seam signal from the light barrier 39, the control circuit 52 causes the stepping motor 16 to reset itself with corresponding reduction of the minimum spacing of the fabric deflector, whereupon the angular speed of the main shaft 25 rises again to the original level.

The light barrier 39 is matched to the particular sewing material 4 by sewing a specific number of stitches and by the light source 40 periodically emitting several "flashes" at each stitch upon a given time after the end "A" of the associated measurement window signal "A" during the sewing material transport phase. An average may be formed from the corresponding output signals of the light detector 41 in the control circuit 52. These averages of all stitches performed are used by the control circuit 52 to compute one final mean revealing whether or not during sewing a cross seam passes the light barrier 39.

The foregoing description is provided for illustrative purposes only and should not be construed as in any way limiting this invention, the scope of which is defined solely by the appended claims.

What is claimed is:

1. A blind stitch sewing machine having an arc needle with a tip, main drive means to oscillate the needle along an arcuate path and a fabric deflector movable in a plane of motion intersecting the arcuate path to bear against a material being sewn comprising:

(a) means to oscillate the fabric deflector in its plane of motion to contact the fabric being sewn to deflect the fabric into the arcuate path of the arc needle, the means including a stepping motor for adjusting the fabric deflector oscillation with respect to the arcuate path;

(b) a sewing material sensor generating an output signal depending upon the thickness of the fabric;

(c) a contact pickup to generate an electrical signal upon contact between the arc needle and the fabric deflector;

(d) measurement window pickup means operatively associated with the drive means to generate a measurement window signal for each stitch commencing shortly before the tip of the arc needle reaches the plane of motion of the fabric deflector and ending with the onset of the motion of the fabric deflector away from the arcuate path of the arc needle; and, (e) control circuit means operatively connected to the stepping motor, the contact pickup, the sewing fabric sensor and the measurement window pickup means such that the stepping motor places the fabric deflector in a starting position displaced away from the arcuate path of the arc needle and, in the course of a subsequent sewing operation, moves the fabric deflector closer to the arcuate path until the contact pickup generates its signal during the measurement window signal and such that, at the end of the measurement window signal, the stepping motor moves in the opposite direction a predetermined number of steps dependent upon the output signal from the sewing fabric sensor to provide a minimum spacing for the fabric deflector.

2. The blind stitch sewing machine according to claim 1 wherein the control circuit means further comprises:

(a) means to determine a start position of the stepping motor for a particular arc needle in the absence of thread and sewing material so that, upon a trigger signal to the control circuit, the stepping motor moves into a specific initial positon and upon the ensuing sewing machine operation at minimal speed continues to move by one step for each measurement window signal with a corresponding decrease in the minimum spacing of the fabric deflector until the contact pickup emits its contact signal during one measurement window signal;

(b) means to add to the then extant position of the stepping motor a specific number of steps commensurate with enlargement of the minimum spacing of the fabric deflector as is required by machine and arc needle tolerances; and, (c) means to store data relating to the start position so obtained.

3. The blind stitch sewing machine according to claim 1 wherein the control circuit means further comprises means to rotate the stepping motor into its start or initial position past a specific reference position at which the minimum spacing of the fabric deflector corresponds to an adjusted null spacing and from which the stepping motor moves by specific number of steps into said start or initial position so that the minimum spacing of the fabric deflector is proportionately enlarged and the arc needle cannot touch the fabric deflector.

4. The blind stitch sewing machine according to claim 3 further comprising a yoke light barrier operatively associated with the stepping motor and connected to the control circuit means to generate a signal when the stepping motor is in the reference position.

5. The blind stitch sewing machine according to claim 1 wherein the control circuit means further comprises means to control the stepping motor such that it will continue to rotate as a function of the output signal of the sewing fabric sensor, but by a lesser numbr of steps whenever during further sewing while setting the minimum spacing of the fabric deflector a contact signal for the needle and fabric deflector is emitted by the contact pickup during one measurement window signal, whereby the minimum spacing of the fabric deflector is commensurately enlarged.

6. The blind stitch sewing machine according to claim 5 wherein the control circuit means further comprises means to deactivate the stepping motor if, upon further sewing and during a specific number of stitches, no contact signal is generated by the contact pickup concerning the arc needle and the fabric deflector during a measurement window signal.

7. The blind stitch sewing machine according to claim 1 including an actuating means for a sewing material depressor associated with the fabric deflector wherein the control circuit means further comprises means connected to the actuating means for the sewing material depressor to drive the actuating means such that the sewing material depressor exerts an increased compression while the minimum spacing of the fabric deflector is being set.

8. The blind stitch sewing machine according to claim 1 wherein the control circuit means further comprises storage means to store data relating to the rotational setting of the stepping motor corresponding to the set minimum spacing of the fabric deflector.

9. The blind stitch sewing machine according to claim 1 wherein the control circuit means further comprises means to arbitrarily set the minimum spacing of the fabric deflector by means of the stepping motor.

10. The blind stitch sewing machine according to claim 1 wherein the control circuit means further comprises means to switch the control circuit to interval operation, wherein the stepping motor adjusts itself for each interval stitch by a number of steps dependent on the output signal from the sewing material sensor with corresponding enlargement of the minimum spacing of the fabric deflector and wherein, upon raising the fabric deflector, the control circuit means switches back to normal operation.

11. The blind stitch sewing machine according to claim 1 wherein the control circuit means further comprises means to switch the sewing machine to seam locking operation wherein the stepping motor adjusts itself for a specific number of stitches by a numbr of steps dependent on the output signal from the sewing material sensor with corresponding enlargement of the minimum spacing of the fabric deflector.

12. The blind stitch sewing machine according to claim 1 wherein the control circuit means further comprises:

(a) means to switch into a state for cross seam recognition;

(b) a light barrier having a light source and a light detector, and adapted to emit a cross seam output signal when the control circuit means is in the cross seam recognition state; and, (c) means connected to the control circuit means to first lower the angular speed of the main drive means and then adjust the stepping motor by a number of steps dependent on the output signal from the sewing material sensor with corresponding enlargement of the minimum spacing of the fabric deflector, wherein, at the end of the cross seam signal the stepping motor resets itself with a corresponding reduction of the minimum spacing of the fabric deflector and thereupon the main drive means is actuated to raise the angular speed to the original value.

13. The blind sewing machine according to claim 12 wherein the control circuit means further comprises:

(a) means to match the light barrier to a particiular sewing material such that, when sewing a particular number of stitches, the light source of the light barrier is periodically turned on following a specific time intrval beyond the end of the associated measurement window dignal during transportion of the sewing material;

(b) means to compute an average from the corresponding output signals of the light detector of the light barrier;

(c) means to compute a final mean value from the averages so obtained which serves as reference for the cross seam recognition.

14. The blind stitch sewing machine according to claim 12 further comprising:

(a) a throat plate; and, (b) a movable sheet metal guide for the sewing material spring loaded toward the throat plate in the zone of the light barrier on the side of the throat plate away from the arc needle.

15. The blind stitch sewing machine according to claim 1 wherein the sewing material sensor comprises:

(a) a pivot arm;

(b) means to spring bias the pivot arm toward a throat plate;

(c) a measuring roller mounted on a free end of the pivot arm adapted to bear against the sewing material;

(d) a permanent magnet; and, (e) a magnetic field sensor cooperating with the permanent magnet and adapted to generate an output signal.

16. The blind stitch sewing machine according to claim 15 wherein the control circuit means further comprises means to detect and store the output signal from the magnetic field sensor only within the first measurement window signal appearing when sewing.

17. The blind stitch sewing machine according to claim 1 wherein the contact pickup for the arc needle and fabric deflector comprises:

(a) means to electrically insulate the fabric deflector from a machine frame; and (b) means to lead the fabric deflector with a low amplitude, high frequency alternating current to achieve capactive coupling with the arc needle.

18. The blind stitch sewing machine according to claim 1 wherein the measurement window pickup means is operatively associated with a main drive shaft of the sewing machine.

19. The blind stitch sewing machine according to claim 1 further comprising:

(a) an eccentric sleeve defining an eccentric bore and operatively associated with the stepping motor; and, (b) means to rotatably support the sleeve in a frame of the sewing machine wherein said sleeve, in turn, supports in its eccentric bore a first drive shaft for the fabric deflector.

20. The blind stitch sewing machine according to claim 19 further comprising clampable bearing means to support the eccentric sleeve without play at least at an end adjacent to the fabric deflector.

21. The blind stitch sewing machine according to claim 19 further comprising:

(a) a second drive shaft rotatably supported in the frame of the sewing machine; and (b) offset compensating coupling means connecting the second drive shaft to the first drive shaft for the fabric deflector.

22. The blind stitch sewing machine according to claim 19 further comprising:

(a) means to spring load the fabric deflector toward the arcuate path of the arc needle; and, (b) means attached to the first drive shaft to displace the fabric deflector against its spring loading.

23. The blind stitch sewing machine according to claim 22 further comprising means to adjust the spring loading of the fabric deflector.

24. The blind stitch sewing machine according to claim 22 wherein the means to spring load the fabric deflector comprises a leaf spring.

* * * * *

UNITED STATES PATENT AND TRADEMARK OFFICE

CERTIFICATE OF CORRECTION

PATENT NO. : 4,896,617

DATED : January 30, 1990

INVENTOR(S) : HAUSER ET AL

It is certified that error appears in the above-identified patent and that said Letters Patent is hereby corrected as shown below:

Col. 1, line 62, "tunr" should be --turn--;
line 65, "a" should be --the--.

Col. 2, line 49, "illustratifng" should be --illustrating--;
line 50, "thickenss" should be --thickness--;
line 64, "thi" should be --this--.

Col. 4, line 32, after "an", insert --actuation means--;
line 43, after "by", insert --an--;
line 65, "being", should be --begin--.

Col. 5, line 1, "of" third occurrence, should be --or--;
line 36, " "B" ", should be --" B' "--.

Col. 6, line 6, " "d" fo", should be --" d' " of--;
line 15, "oeprational" should be --operational--;
line 46, "ont he" should be --on the--;
line 47, "matrial", should be --material--.

Col. 7, line 12, " "A" ", first occurrence, should be --" A' "--.

UNITED STATES PATENT AND TRADEMARK OFFICE

CERTIFICATE OF CORRECTION

PATENT NO. : 4,896,617

DATED : January 30, 1990

INVENTOR(S) : HAUSER ET AL

It is certified that error appears in the above-identified patent and that said Letters Patent is hereby corrected as shown below:

Col. 8, line 10, after "extant", insert --rotational--;

line 37, "numbr" should be --number--;

line 40, before "needle", insert --arc--.

Col. 9, line 15, "numbr" should be --number--;

line 41, after "blind" insert --stitch;

line 47, "intrval" should be --interval--;

line 48, "dignal", should be --signal--.

Col. 10, line 23, "lead" should be --load--;

line 25, "capactive" should be --capacitive--.

Signed and Sealed this

Twenty-fourth Day of July, 1990

*Attest:*

HARRY F. MANBECK, JR.

*Attesting Officer*

*Commissioner of Patents and Trademarks*